US006590341B1

(12) United States Patent
Kitano et al.

(10) Patent No.: US 6,590,341 B1
(45) Date of Patent: Jul. 8, 2003

(54) DISCHARGE LAMP WITH FOIL-STIFFENING CREASE

(75) Inventors: Hiroyoshi Kitano, Himeji (JP); Takahiro Mizuno, Himeji (JP); Kengo Sato, Takasago (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 158 days.

(21) Appl. No.: 09/610,571

(22) Filed: Jul. 5, 2000

(30) Foreign Application Priority Data

Jul. 5, 1999 (JP) ..... 11-190495

(51) Int. Cl.[7] ..... H01J 17/18; H01J 61/38

(52) U.S. Cl. ..... 313/623; 313/332; 313/331

(58) Field of Search ..... 313/623, 624, 313/625, 631, 283, 332, 633, 331, 318.07; 445/26, 43

(56) References Cited

U.S. PATENT DOCUMENTS

| | | | | | |
|---|---|---|---|---|---|
| 4,254,356 | A | * | 3/1981 | Karikas | 313/623 |
| 4,749,905 | A | * | 6/1988 | Mori et al. | 313/623 |
| 5,087,218 | A | * | 2/1992 | Ahlgren et al. | 445/27 |
| 5,138,227 | A | * | 8/1992 | Heider et al. | 313/623 |
| 5,430,353 | A | * | 7/1995 | Feldman et al. | 313/623 |
| 5,896,004 | A | * | 4/1999 | Feldman et al. | 313/493 |
| 6,132,279 | A | * | 10/2000 | Horiuchi et al. | 445/26 |
| 6,291,934 | B1 | * | 9/2001 | Berger et al. | 313/623 |

* cited by examiner

*Primary Examiner*—Ashok Patel
*Assistant Examiner*—Glenn Zimmerman
(74) *Attorney, Agent, or Firm*—Nixon Peabody LLP; David S. Safran

(57) ABSTRACT

A discharge lamp having a pair of electrodes (2) within a light-emitting tube (30) with air-tight seals (31) formed covering a metallic foil (1) is bonded to each electrode (2). To stiffen the metallic foil, it is provided with a length-wise crease (M).

4 Claims, 6 Drawing Sheets

(Prior Art)

DISCHARGE LAMP WITH FOIL-STIFFENING CREASE

BACKGROUND OF THE INVENTION

1. Field of the Invention

This invention concerns a discharge lamp used in such applications as a light source for projection equipment.

2. Description of Related Art

Overhead projectors (OHP) and liquid crystal projectors have come to be used as presentation tools in recent years. Discharge lamps, such as metal halide lamps and mercury lamps, have superior color display characteristics, and have been used as light source lamps in such projection equipment.

Discharge lamps having unprecedentedly high mercury vapor pressure, perhaps 100 atm. or more, have been developed recently in an effort to provide even greater light output and better color display characteristics. Such a high-pressure discharge lamp has remarkably high mercury vapor pressure while lit, and so the light-emitting tube and the seals formed on both sides of it require extremely great resistance to pressure.

Methods for forming the seal include the pinch seal method and the method of applying negative pressure to the bulb proper, which comprises the part that will be come the light-emitting tube and the side tubes that will become the seals, and while heating a side tube, constricting its diameter to form the seal (called the "shrink seal method" hereafter). The pinch seal method is limited to a pressure resistance of about 40 atmospheres, and so the pinch seal method cannot be adopted for the discharge lamps described above; seals have been formed using the shrink seal method with its higher pressure resistance.

This shrink seal method is explained here with reference to FIGS. 4*a*–4*c* of the drawings. As shown in FIG. 4(*a*), a mount comprises an electrode 2 with one end bonded to a metallic foil 10 made of molybdenum 10 to 60 $\mu$m thick, and an external lead bar 5, one end of which is attached to a ribbon of positioning foil 4 to allow the mount to be positioned within the bulb proper 3 and the other end of which is bonded to the opposite end of the molybdenum foil 10 from the electrode 2. Then, as shown in FIG. 4(*b*), the mount is inserted into the bulb proper 3 and positioned so that the positioning foil 4 is in contact with the inside wall of the side tube 3S. With negative pressure applied to the bulb proper 3, the side tube 3S is heated and shrunk to seal the side tube 3S, after which a seal is formed on the other side in the same way. Then, the unnecessary portion of the side tube 3S is cut off to complete the manufacture of a discharge lamp with shrink-sealed seals 31, as shown in FIG. 4(*c*).

In lamps of this sort, however, the metallic foil 10 is thin, and thus, easily bent in directions crosswise to the length of the metallic foil 10, and it sometimes happens when the mount is inserted in the bulb proper 3 and positioned that, as seen in FIG. 5 (which is a view from the direction of the edge of the metallic foil 10), the metallic foil 10 will be bent away from the center line X of the light-emitting tube, so that the electrodes 2 are shrink sealed away from the center line X.

Moreover, even if the electrode 2 is accurately positioned on the center line X of the light-emitting tube 30 prior to the shrink seal process, it sometimes happens that when the side tube 3S is shrunk during the shrink seal process, the metallic foil 10 bends in a direction crosswise to the length of the metallic foil 10, in which case the electrode 2 ends up in a position away from the center line X of the light emitting tube 30.

There has been a problem, with lamps of this sort, that the electrodes 2 would be closer than necessary to the light-emitting tube 30, and the arc would touch the tube wall and cause blackening of the light-emitting tube 30. Even if it does not come to blackening of the light-emitting tube 30, if the arc spot is not in the correct position, then if the discharge lamp is combined with a mirror, the focus of the mirror will not match the arc spot and it will not be possible to attain the expected light distribution and light output. Moreover, the voltage is decided such that the light output from the discharge lamp will stable, and if the inter-electrode distance is changed by misplacement of the electrodes 2, the voltage will change and the expected light output will not be attained.

SUMMARY OF THE INVENTION

This invention was based on the situation described above, and has the purpose of providing a discharge lamp in which the electrodes are properly positioned within the light-emitting tube.

In order to resolve the problems described above, the discharge lamp in accordance with the invention has a pair of electrodes within a light-emitting tube with an air-tight seal formed covering metallic foil attached to each electrode, in which there is a length-wise fold in the metallic foil and the electrodes are bonded to the metallic foil.

DETAILED DESCRIPTION OF THE INVENTION

Figure 1:
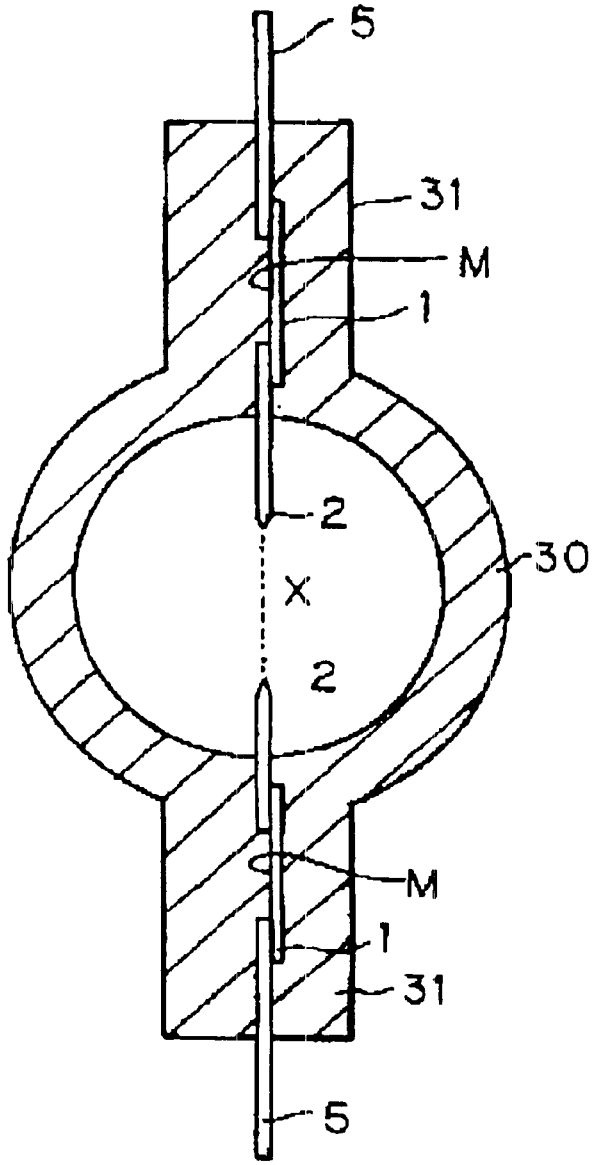
FIG. 1 is a sectional view showing the discharge lamp of this invention looking toward the edge of the foil.

FIG. 1 is an explanatory drawing, viewed from the direction of the edge of the metallic foil, of the discharge lamp of this invention. The discharge lamp is made of quartz glass, and is formed with a light-emitting tube 30 and shrink-sealed seals 31 on opposite sides. Within the light-emitting tube 30 is a pair of electrodes 2 with an inter-electrode gap of 0.1 to 6.0 mm. The outer ends of the electrodes (i.e., those opposite the arc gap forming ends) are welded to pieces of metallic foil 1 made of 10 to 60 $\mu$m thick molybdenum that are embedded in the seals 31. External lead bars 5 are welded to the outer ends of the metallic foil (i.e., those opposite the ends attached to the electrodes 2), and these external lead bars 5 extend out from the seals 31.

Mercury is enclosed in the light-emitting tube 30 as a light-emitting substance together with and inert gas, such as argon or xenon, which is used as a starting gas. The amount of mercury enclosed is such that the vapor pressure, when the bulb is burning stably, will be at least 100 atmospheres.

Figure 2:
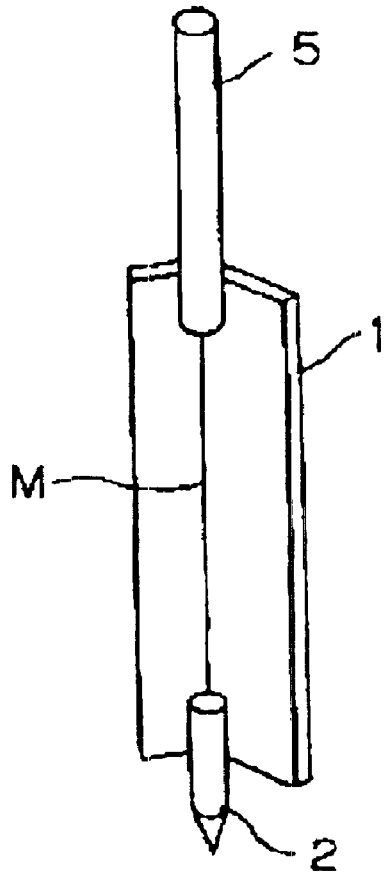
FIG. 2 a perspective view of the metal foil of the discharge lamp of this invention, and of an electrode and external lead bar bonded to the metallic foil.

FIG. 2 shows the metallic foil to which the electrode and external lead bar are welded in the discharge lamp of this invention. The metallic foil 1 is creased lengthwise, i.e., along the length of the seal 31 to form a crease M. Then, an end of the electrode 2 is welded into the crease M. Because the metallic foil 1 is folded in this way, the metallic foil 1 is stiffened in directions transverse to the length of the foil, and so it is possible to prevent bending of the metallic foil 1.

As shown in FIG. 2, the crease M is formed along the full length of the metallic foil 1. However, it is not necessary that it be formed along the full length of the metallic foil 1; it is also possible to form partial lengthwise creases M extending from both ends or from either end of the metallic foil 1. The key point is that the metallic foil 1 be stiffened against crosswise bending, and there are no particular limits on the length or position of the crease M. Moreover, it is not necessary that the electrode 2 be welded to the metallic foil 1 at the crease M; it can be welded at any position on the metallic foil 1; although, it is particularly advantageous to do so at this point since it then will contact the foil 1 at both sides of the crease M so as to act on the foil in a way that best benefits from the created stiffness, not to mention that it facilitates proper positioning of the foil, both relative to the lead 5 (which can be similarly attached at the opposite end of the foil 1 and relative to the light-emitting tube 30.

Figure 3:
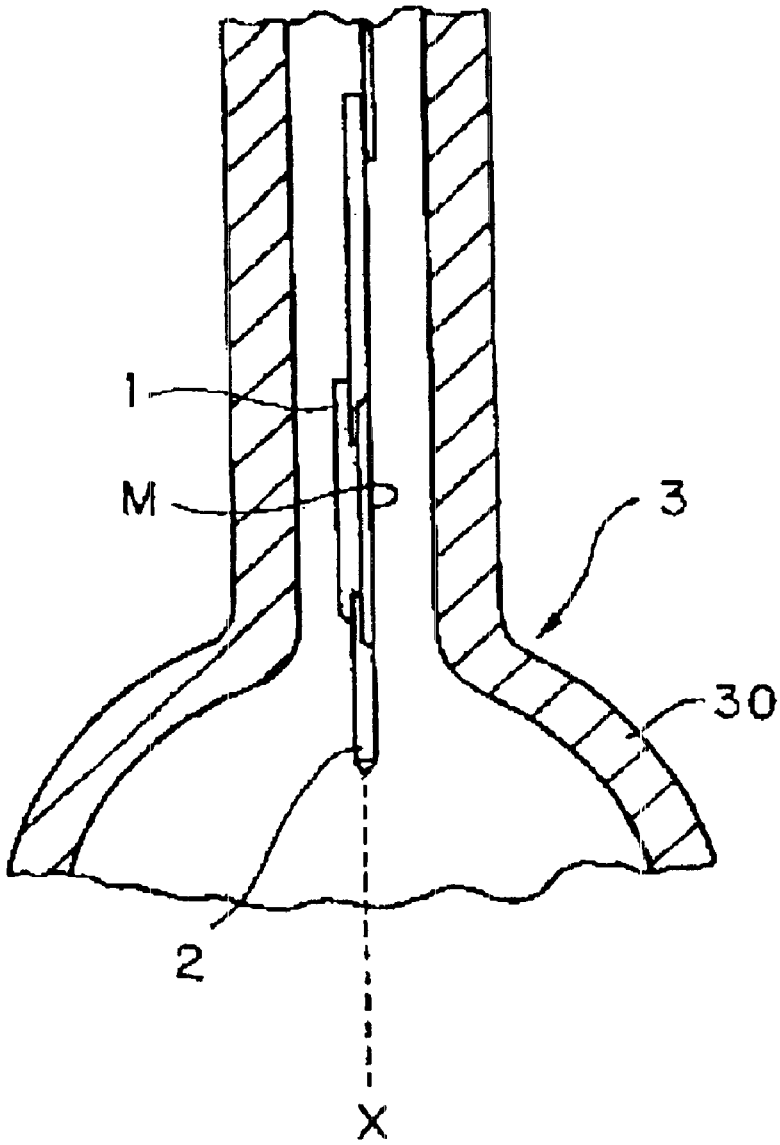
FIG. 3 is an explanatory drawing, viewed from an angle slightly removed from the edge of the metallic foil, of the mount inserted in the bulb proper in the process of manufacturing the discharge lamp of this invention.
Figures 4A, 4B, 4C:
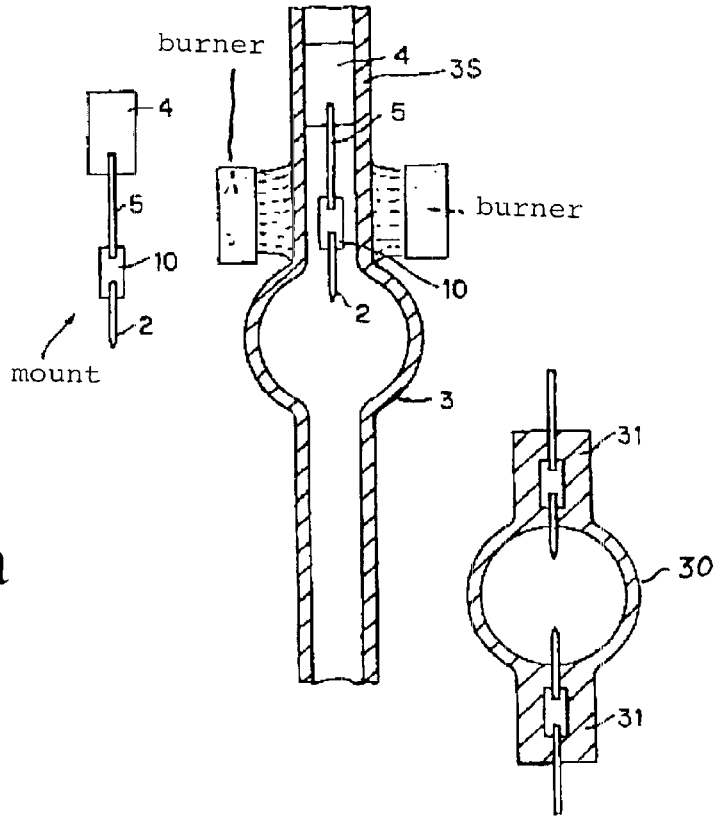
FIG. 4 is a drawing for explaining the shrink seal method.
Figure 5:
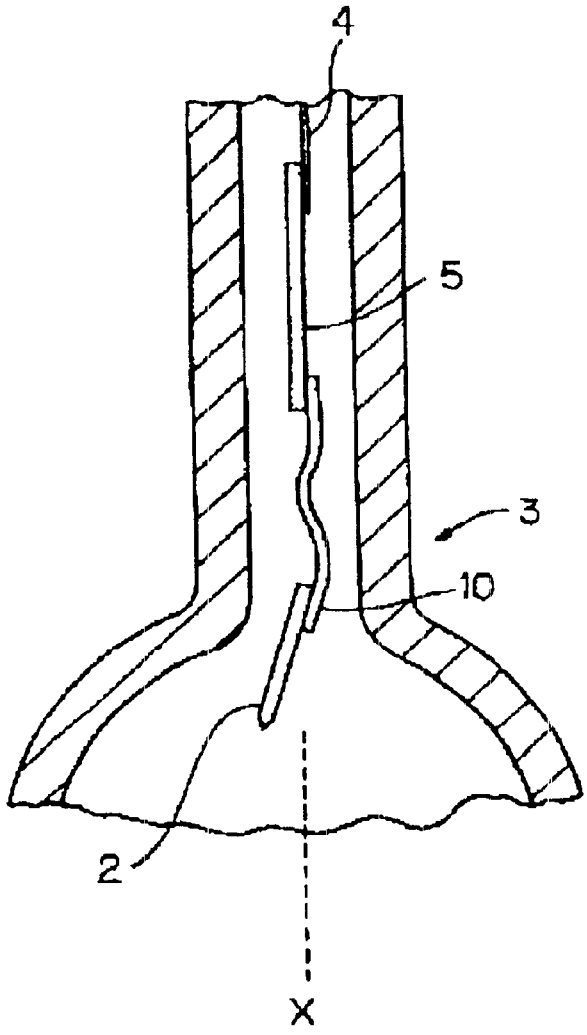
FIG. 5 (Prior Art)
FIG. 5 is a drawing, viewed from the edge of the metallic foil, of the mount inserted in the bulb proper for explaining a problem associated with the conventional process of manufacturing discharge lamps.
Figure 6:
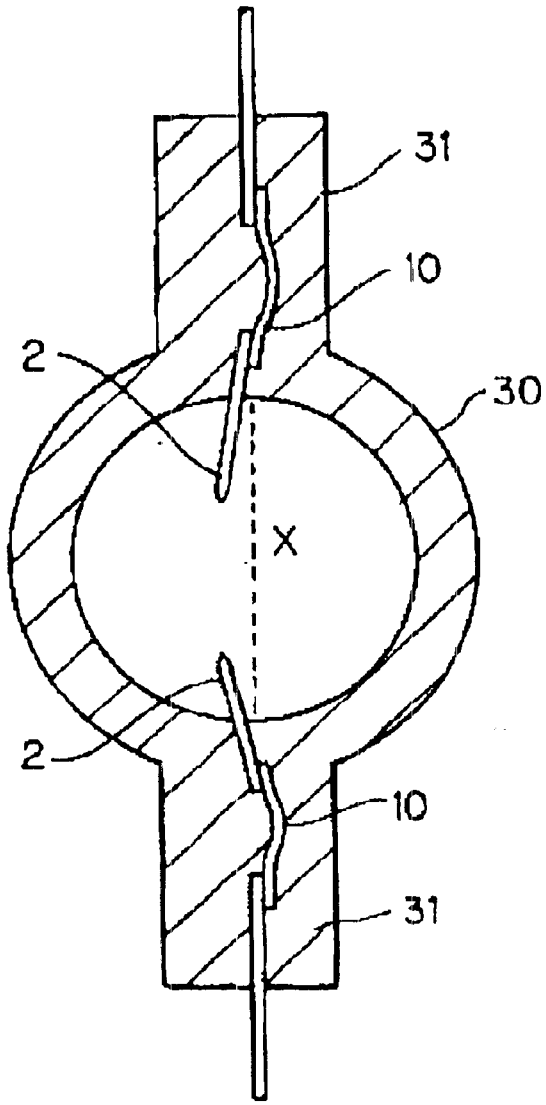
FIG. 6 (Prior Art)
FIG. 6 is drawing, viewed from the edge of the metallic foil, for explaining a problem associated with production of the conventional discharge lamp.

As shown in FIG. 3, which is viewed from an angle slightly removed from the edge of the metallic foil, when the mount with the end of the electrode 2 welded to the crease M of the metallic foil 1 is inserted in the bulb proper 3 and positioned, the metallic foil 1 does not bend in a direction transverse to its lengthwise direction, and so the electrode 2 can be positioned accurately on the center line X of the light-emitting tube 30. Moreover, the strength of the metallic foil 1 during the shrink-seal process to form the seal is increased, and so during the shrink-seal process the metallic foil 1 does not bend and the electrode 2 does not depart from the center line X of the light-emitting tube 30. Accordingly, it is possible to position the electrode 2 quite accurately on the center line X of the light-emitting tube 30, which is the desired position in the light-emitting tube 30.

Consequently, in the discharge lamp of this invention, the electrodes can be positioned in the desired position in the light-emitting tube, and so the arc does not contact the tube wall and the tube is not blackened. In addition, the arc spot is in the expected position in the light-emitting tube, and so if the beam emitted by the discharge lamp is directed by a mirror, the focus of the mirror matches the arc spot, and the desired light distribution and light output can be attained. Moreover, the discharge lamp of this invention that is shrink-sealed using the method described above always has the designed inter-electrode distance in every discharge lamp even when multiple discharge lamps are manufactured, and so the voltage of all lamps is stable and the expected light output can be attained.

EFFECT OF INVENTION

As explained above, in the discharge lamp of this invention, there is a lengthwise crease in the pieces of metallic foil that are covered by the seal, and an end of each electrode is welded to these pieces of metallic foil, so that the metallic foil is stiffened in directions transverse to the lengthwise direction of the foil, and bending of the metallic foil can be prevented.

Accordingly, the electrodes can be positioned accurately on the center line of the light-emitting tube, and the stiffness of the metallic foil is also increased during the shrink-seal process to form the seals; therefore the metallic foil does not bend during the shrink-seal process, and so it is possible to position the electrodes quite accurately in the desired position in the light-emitting tube.

What is claimed is:

1. A discharge lamp having a pair of electrodes within a light-emitting tube, each electrode being bonded to a metallic foil within air-tight seals which cover the metallic foil, wherein the metallic foil has a foil-stiffening crease running in its lengthwise direction; and wherein the electrodes are attached in or on the crease.

2. A discharge lamp according to claim 1, wherein the crease extends the full length of the metallic foil.

3. A discharge lamp according to claim 1, wherein an external lead wire is attached to an opposite end of each foil from the respective electrode.

4. A discharge lamp having a pair of electrodes within a light-emitting tube, each electrode being bonded to a metallic foil within air-tight seals which cover the metallic foil, wherein the metallic foil has a foil-stiffening crease running in its lengthwise direction; and wherein the lead wires are attached in or on the crease.

* * * * *